US006043603A

United States Patent [19]

Weinhardt

[11] Patent Number: 6,043,603

[45] Date of Patent: Mar. 28, 2000

[54] LOW-PRESSURE DISCHARGE LAMP HAVING AN ANGULARLY ORIENTED SUPPORT MEMBER BEARING A MERCURY-CONTAINING COATING AND A GETTER COATING

[75] Inventor: Erolf Weinhardt, Diedorf, Germany

[73] Assignee: Patent-Treuhand-Gesellschaft fuer elektrische Gluehlampen mbH, Munich, Germany

[21] Appl. No.: 09/068,942

[22] PCT Filed: Jun. 27, 1997

[86] PCT No.: PCT/DE97/01355

§ 371 Date: May 21, 1998

§ 102(e) Date: May 21, 1998

[87] PCT Pub. No.: WO98/14983

PCT Pub. Date: Apr. 9, 1998

[30] Foreign Application Priority Data

Sep. 30, 1996 [DE] Germany ..... 296 16 879 U

[51] Int. Cl.[7] ..... H01J 61/24

[52] U.S. Cl. ..... 313/566; 552/556; 552/562; 552/564; 552/566

[58] Field of Search ..... 313/552, 553, 313/556, 559, 562, 564, 565, 566

[56] References Cited

U.S. PATENT DOCUMENTS 4,308,650 1/1982 Hernandez et al. ..... 313/556

FOREIGN PATENT DOCUMENTS 0359724 3/1990 European Pat. Off. .
0473164 3/1992 European Pat. Off. .
2616577 11/1976 Germany .
6-96728 4/1994 Japan .

*Primary Examiner*—Ashok Patel
*Attorney, Agent, or Firm*—Carlo S. Bessone

[57] ABSTRACT

The invention relates to a low-pressure discharge lamp with at least one supporting element (12) placed inside a discharge vessel (10). Said supporting element is provided with a mercurial coating (13) and is coated with a getter material (14). The coated surfaces of the supporting element (12) are inclined at an angle of at least 30 degrees in relation to the longitudinal axis (A—A) of the discharge vessel (10).

14 Claims, 5 Drawing Sheets

LOW-PRESSURE DISCHARGE LAMP HAVING AN ANGULARLY ORIENTED SUPPORT MEMBER BEARING A MERCURY-CONTAINING COATING AND A GETTER COATING

TECHNICAL FIELD

The invention relates to a low-pressure discharge lamp.

BACKGROUND ART

Japanese Published Application JP 6-96728 discloses a low-pressure mercury vapour discharge lamp having two essentially identical electrode frames sealed in the ends of the tubular discharge vessel. The electrode frames each have an electrode filament which is arranged transverse to the discharge vessel axis and is surrounded by an annular metal strip—a so-called ring cap. The ring axis of this annular metal strip extends parallel to the discharge vessel axis. The ring cap is assembled from two segments, of which one segment is coated with an amalgam, in particular with a mercury-titanium alloy, while the other segment is provided with a getter coating which binds the gaseous contaminants in the discharge vessel. The amount of mercury in the low-pressure discharge lamp is controlled via the length of the first segment. While the lamp is being produced, the ring caps are heated inductively with the aid of an electromagnetic radio frequency signal to a temperature of approximately 900° C. to 950° C. As a result, on the one hand the getter is activated, and on the other hand the mercury is released from the mercury alloy. The required radio frequency signal is usually generated by means of a radio frequency inductor which has an induction loop with two long legs extending parallel to one another, and which generates at the location of the ring caps an electromagnetic radio frequency field whose magnetic field extends essentially parallel to the discharge vessel axis and thus also parallel to the ring axis of the ring caps. The lamps require approximately 20 to 30 seconds to traverse this radio frequency field. Because of their dimensions, such ring caps are not suitable for low-pressure discharge lamps whose discharge vessel has an outside diameter of less than or equal to 16 mm.

German patent DE 26 16 577 describes a low-pressure discharge lamp, in particular a fluorescent lamp, which is provided with a mercury-containing ionizable filling inside the discharge vessel. The mercury component in the ionizable discharge medium is here approximately 5 mg to 20 mg. Since such low amounts of mercury can be dosed in the form of drops only with difficulty, the mercury is introduced into the discharge vessel with the aid of a support member which is provided with a mercury-containing coating and additionally also with a getter. The mercury-containing coating and the getter are applied to a metal strip, which is arranged parallel to the longitudinal axis of the lamp and is a component of an electrode frame of the low-pressure discharge lamp, that is to say the coated surfaces of the metal strip extend essentially in an axially parallel fashion. During production of the lamp, the metal strip is inductively heated by means of an electromagnetic radio frequency signal for approximately 20 to 30 seconds to a temperature of approximately 900° C. to 950° C. in order to release the mercury and activate the getter.

DISCLOSURE OF THE INVENTION

It is the object of the invention to provide a low-pressure discharge lamp having an improved support member which bears a mercury-containing coating and a getter coating. In particular, this support member is also to be suitable for low-pressure discharge lamps which have a mercury content of less than 10 mg and of which the outside diameter of the discharge vessel is less than or equal to 16 mm. Moreover, it is also to be possible to use the radio-frequency inductor, which is used to produce the low-pressure discharge lamps fitted with the above-described ring caps, to produce the lamps provided with the improved support member, with the result that there is no need to convert the production line.

The low-pressure discharge lamp according to the invention has a tubular discharge vessel which, at least in the region of its ends, has a longitudinal axis, and in whose interior one or more support members are arranged which has or have at least one first surface provided with a mercury-containing coating and at least one second surface provided with a getter coating. These surfaces, coated in such a way, of the support member or of the support members are inclined by an angle of at least 30 degrees to the longitudinal axis of the tubular discharge vessel or to the longitudinal axis of the discharge vessel ends.

It is thereby ensured that the support members of the low-pressure discharge lamps according to the invention can be inductively heated sufficiently with the aid of the radio-frequency inductor normally used for inductive heating of the ring caps. During production of the lamp, the lamp ends or the discharge vessel ends traverse the electromagnetic field of the radio-frequency inductor, whose magnetic field lines at the location of the support member extend essentially parallel to the longitudinal axis of the discharge vessel or of the discharge vessel end. Since the surfaces of the support member which are provided with the getter coating and the mercury-containing coating are inclined by at least 30 degrees to the longitudinal axis of the discharge vessel end, because of its favourable orientation the electromagnetic field of the radio-frequency inductor induces in the region of these coated surfaces of the support member a comparatively high current, and thus renders it possible for these surfaces to be heated up sufficiently. The radio-frequency field achieves its optimum effect when the magnetic field lines are orientated perpendicular to the surfaces provided with the getter material and mercury-containing coating. For this reason, the surfaces, coated with the getter and with the mercury alloy, of the support members of the low-pressure discharge lamps according to the invention are advantageously arranged perpendicular to the longitudinal axis of the discharge vessel end. In the case of the particularly preferred exemplary embodiments of the invention, the support member advantageously comprises a metal plate which is coated with the getter material and with the mercury alloy. This metal plate demands less space than a ring cap and is therefore particularly suitable for low-pressure discharge lamps whose discharge vessel has only a comparatively small diameter—in particular an outside diameter of the discharge vessel which is less than or equal to 16 mm—or in the case of which the use of a ring cap is disadvantageous. Moreover, the application of the invention is suggested in the case of low-pressure discharge lamps having a comparatively low mercury content of less than 10 mg in the ionizable filling and in the case of which a liquid dosing of the mercury in the discharge vessel would be problematic. Precisely in the case of such low amounts of mercury, it is particularly important fully to release the mercury bound in the mercury-containing coating, and thus to heat up the support member optimally, with the result that the optimum mercury vapour pressure can be produced in the discharge space while the lamp is being operated.

In two of the preferred exemplary embodiments, the support member is advantageously constructed as an essentially flat metal plate which is aligned perpendicular to the longitudinal axis of the discharge vessel end and whose front is provided with the mercury-containing coating and whose rear is provided with the getter coating. These metal plates are advantageously welded to a lead-in wire for the electrode filament of the lamp. A simple design of the electrode frame is rendered possible thereby. In the three further exemplary embodiments, the support member is advantageously constructed as a metal plate in the shape of a U or of a V, whose U-leg or V-leg, respectively, arranged transversely or obliquely, respectively, to the longitudinal axis of the discharge vessel end are coated with the getter material and with the mercury alloy.

BRIEF DESCRIPTION OF THE DRAWINGS

The invention is explained in more detail below with the aid of a plurality of preferred exemplary embodiments. In the drawing.

Figure 1:
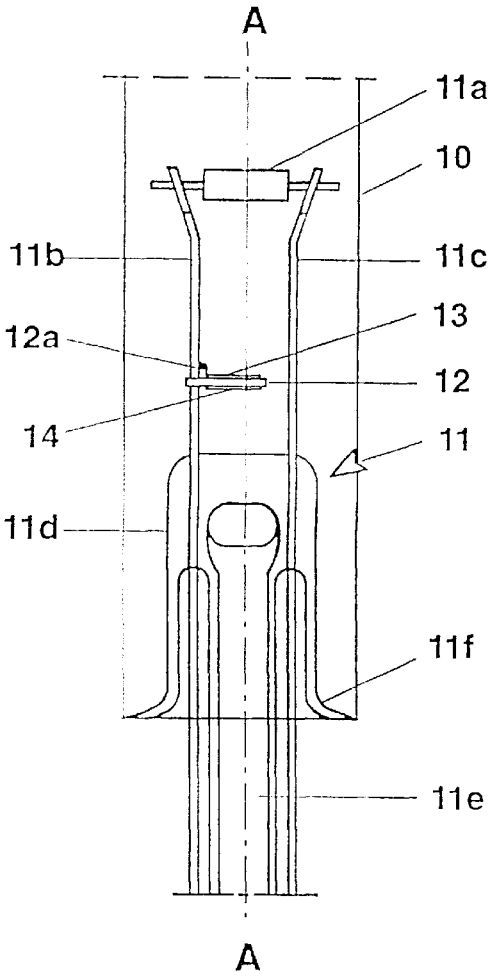
FIG. 1 shows a schematic side view of an end of a low-pressure discharge lamp in accordance with the first exemplary embodiment of the invention.

The lamp according to the invention is a low-pressure mercury vapour discharge lamp, in particular a fluorescent lamp. This lamp has a tubular discharge vessel 10, 20, 30, 40, 50, which can be bar-shaped, bent in the shape of a U or also multiply bent. The two ends of the discharge vessel are sealed in a gastight fashion. An electrode frame 11, 21, 31, 41, 51 is sealed in each case with the ends of the discharge vessel 10, 20, 30, 40, 50. The electrode frames 11, 21, 31, 41, 51 each have an electrode filament 11*a*, 21*a*, 31*a*, 41*a*, 51*a* and two lead-in wires 11*b*, 11*c*, 21*b*, 21*c*, 31*b*, 31*c*, 41*b*, 41*c*, 51*b*, 51*c*, which are connected in an electrically conducting fashion to the ends of the electrode filament 11*a*, 21*a*, 31*a*, 41*a*, 51*a*. The electrode filaments 11*a*, 21*a*, 31*a*, 41*a*, 51*a* are arranged in the interior of the discharge vessel 10, 20, 30, 40, 50 and transverse to the longitudinal axis A—A of the end of the discharge vessel 10, 20, 30, 40, 50. The outside diameter of the discharge vessel 10, 20, 30, 40, 50 is approximately 16 mm. Fastened to one of the two electrode frames 11, 21, 31, 41, 51*a* is a metal plate 12, 22, 32, 42, 52 which is coated with a getter 14, 24, 34, 44, 54 and provided with a mercury-containing coating 13, 23, 33, 43, 53. The metal plates function as support members for the getter material and for the mercury-containing coating. The getter material 14, 24, 34, 44, 54 is a zircon-aluminium getter, and the mercury-containing coating 13, 23, 33, 43, 53 is a mercury-titanium alloy. The lead-in wires 11*b*, 11*c*, 21*b*, 21*c*, 31*b*, 31*c*, 41*b*, 41*c*, 51*b*, 51*c* are led out of the end of the discharge vessel 10, 20, 30, 40, 50. The amount of mercury introduced into the discharge vessel 10, 20, 30, 40, 50 with the aid of the support member is approximately 3 mg. All five exemplary embodiments agree to this extent.

MODE FOR CARRYING OUT THE INVENTION

Figure 2:
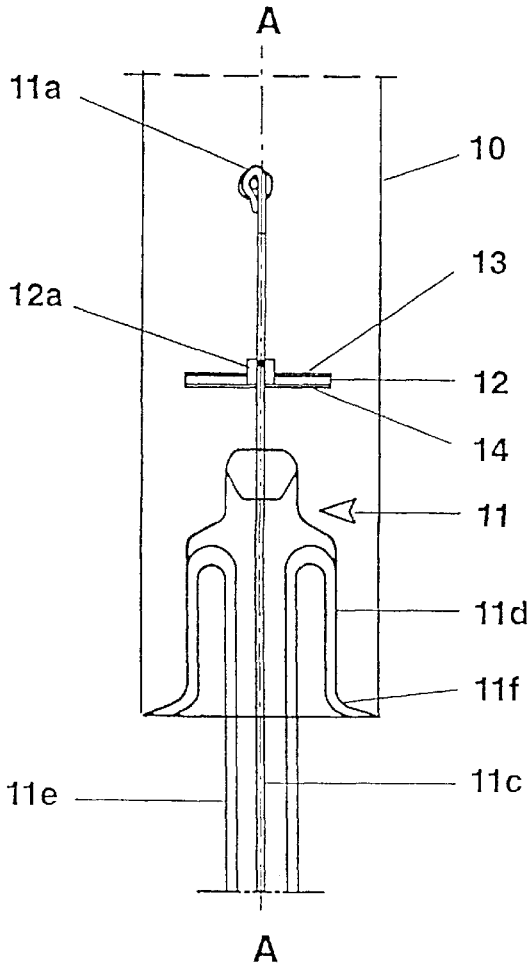
FIG. 2 shows a schematic side view of the lamp end of FIG. 1, rotated by 90°.

Illustrated in a schematic representation in FIGS. 1 and 2 is one end of a low-pressure discharge lamp in accordance with the first exemplary embodiment of the invention. The end of the discharge vessel 10 is sealed with the electrode frame 11 in the manner of a so-called plate-shaped foot seal 11*d*, 11*f*. The electrode frame 11 comprises a glass plate foot 10*d*, whose widened edge 11*f* is sealed in a gastight fashion to the end of the tubular discharge vessel 10, an electrode filament 11*a*, arranged transverse to the longitudinal axis A—A of the discharge vessel, and two lead-in wires 11*b*, 11*c*, which are connected in each case in an electrically conductive fashion to an end of the electrode filament 11*a* and are sealed in the plate foot 11*d*. The glass plate foot 11*d* is provided with an exhaust tube 11*e* which serves to evacuate the discharge vessel 10. Welded onto the one lead-in wire 11*b* is a rectangular, essentially flat metal plate 12 whose one side bears the mercury-containing coating 13, while the other side is coated with the getter 14. The metal plate 12 is aligned perpendicular to the longitudinal axis A—A, with the result that the underside, coated with the getter 14, of the metal plate 12 faces the plate foot 11*d*, and the upper side, provided with the mercury-containing coating, of the metal plate 12 faces the electrode filament 11*a*. In order to facilitate welding the metal plate 12 to the lead-in wire 11*b*, the metal plate 12 has on its edge a welding lug 12*a* bent away at right angles.

Figure 3:
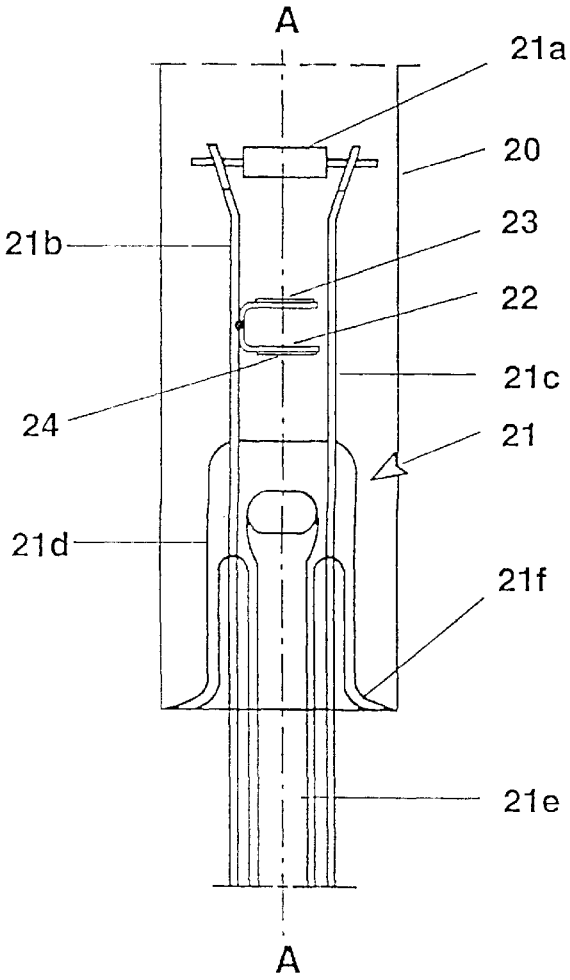
FIG. 3 shows a schematic side view of an end of a low-pressure discharge lamp in accordance with the second exemplary embodiment of the invention.
Figure 4:
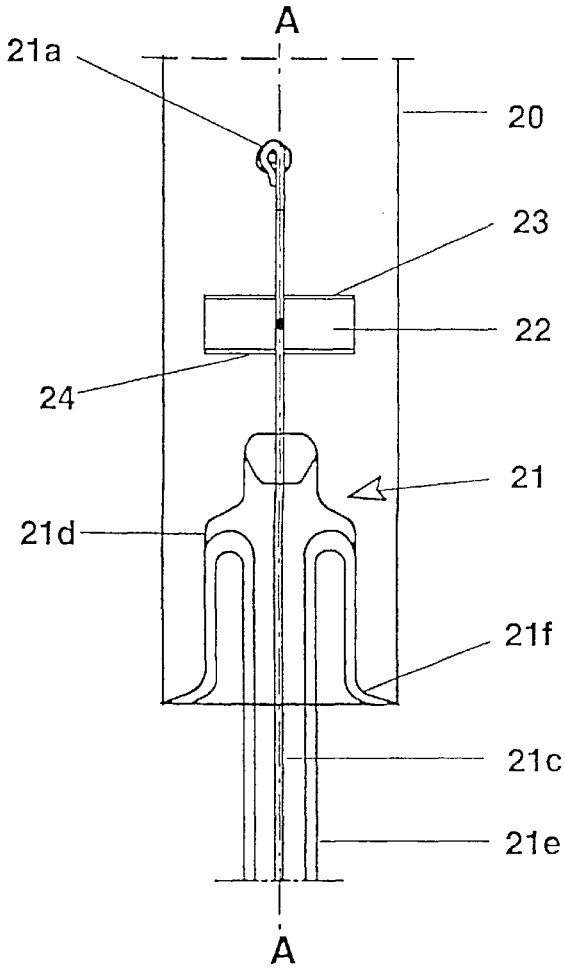
FIG. 4 shows a schematic side view of the lamp end of FIG. 3, rotated by 90°.

FIGS. 3 and 4 show an end of a low-pressure discharge lamp in accordance with the second exemplary embodiment of the invention, in a schematic representation. Here, as well, in a way completely analogous to the first exemplary embodiment, the end of the discharge vessel 20 is sealed with the electrode frame 21 in the manner of a plate-shaped foot seal 21*d*, 21*f*. The electrode frame 21 of the second exemplary embodiment does not differ from the electrode frame 11 of the first exemplary embodiment. It likewise comprises an electrode filament 21*a*, two lead-in wires 21*b*, 21*c* and a glass plate foot 21*d* which is provided with an exhaust tube 21*e* and whose widened edge 21*f* is sealed with the discharge vessel end. By contrast with the first exemplary embodiment, the second exemplary embodiment has a metal plate 22 which is bent in the shape of a U and serves as support member for the getter 24 and the mercury-containing coating 23. The base part, connecting the two U-legs, of the metal plate 22 is welded to the one lead-in wire 21*b*, with the result that the outsides and insides of the U-legs are aligned perpendicular to the longitudinal axis A—A of the end of the discharge vessel 20. The mercury-containing coating 23 is applied to the outside of the U-leg, facing the electrode filament 21*a*, of the metal plate 22, while the getter coating is applied to the outside of the other U-leg, facing the plate foot 21*d*, of the metal plate 12.

Figure 5:
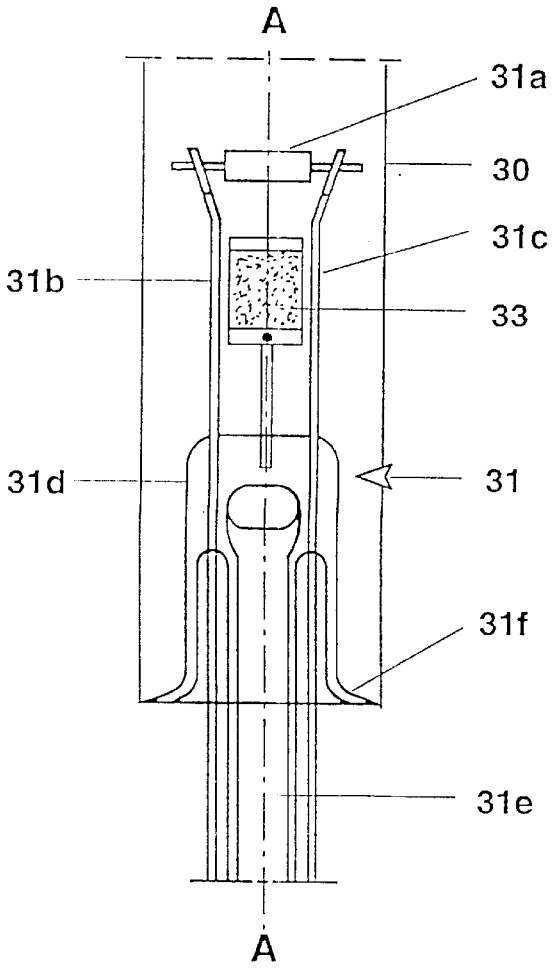
FIG. 5 shows a schematic side view of an end of a low-pressure discharge lamp in accordance with the third exemplary embodiment of the invention.
Figure 6:
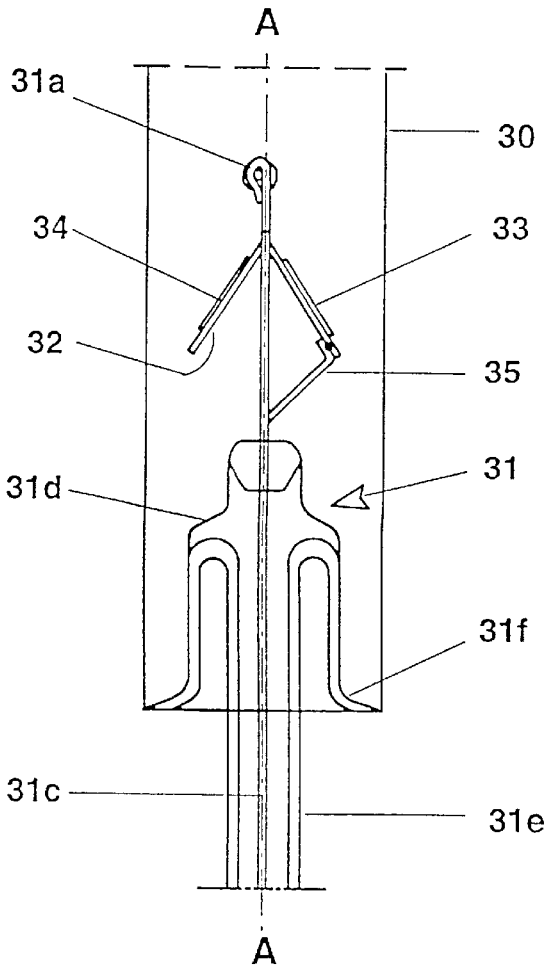
FIG. 6 shows a schematic side view of the lamp end of FIG. 5, rotated by 90°.

In FIGS. 5 and 6, an end of a low-pressure discharge lamp in accordance with the third exemplary embodiment of the invention is illustrated in a schematic representation. Here, as already described in the first two exemplary embodiments, the end of the discharge vessel 30 is sealed with the electrode frame 31 in the manner of a plate-shaped foot seal 31*d*, 31*f*. The electrode frame 31 of the third exemplary embodiment does not differ from the electrode frames 11, 21 of the first two exemplary embodiments. It likewise comprises an electrode filament 31*a*, two lead-in wires 31*b*, 31*c* and a glass plate foot 31*d* which is provided with an exhaust tube 31*e* and whose widened edge 31*f* is sealed with the discharge vessel end. By contrast with the first two exemplary embodiments, the third exemplary embodiment has a metal plate 32 which is bent in the shape of a V and serves as support member for the getter 34 and the mercury-containing coating 33. The V-shaped metal plate is held with the aid of a multiply bent wire 35, which is welded to a V-leg of the metal plate 32 and sealed in the glass plate foot 31*d*. The outer surfaces and inner surfaces of the V-legs of the metal plate 32 are aligned obliquely to the longitudinal axis A—A of the discharge vessel end. They form with it an angle of between approximately 30° and 60°. The metal plate 32 is arranged here below the electrode filament 31*a*, that is to say between the electrode filament 31*a* and the glass plate foot 31*d*. The mercury-containing coating 33 is applied to the outer surface, facing the electrode filament 31*a*, of the one V-leg, while the getter coating 34 is applied to the outer surface, facing the electrode filament 31*a*, of the other V-leg of the metal plate 32.

Figure 7:
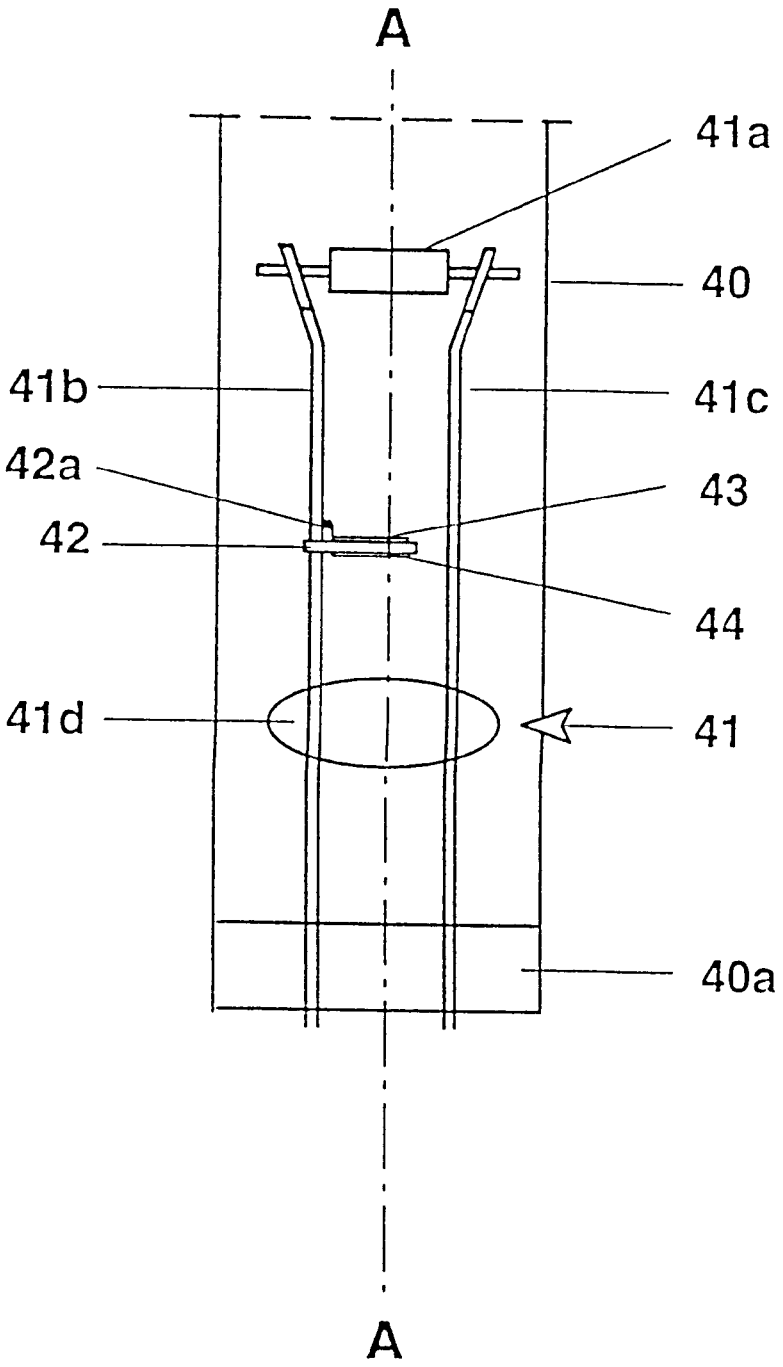
FIG. 7 shows a schematic side view of an end of a low-pressure discharge lamp in accordance with the fourth exemplary embodiment of the invention.

FIG. 7 shows a schematic representation of an end of a low-pressure discharge lamp in accordance with the fourth exemplary embodiment of the invention. In this exemplary embodiment, the electrode frame 41 comprises an electrode filament 41*a*, aligned transverse to the longitudinal axis A—A of the discharge vessel end, two lead-in wires 41*b*, 41*c* and a glass bead 41*d*. The lead-in wires 41*b*, 41*c* are in each case connected in an electrically conducting fashion to an end of the electrode filament 41*a* and sealed in the glass bead 41*d*. The glass bead 41 [sic] lends mechanical stability to the electrode frame 41. The end of the discharge vessel 40 is sealed in a gastight fashion by means of a pinch seal 40*a*. The lead-in wires 41*b*, 41*c* are sealed in a gastight fashion in the pinch seal 40*a* and project out of the discharge vessel end. Welded onto the one lead-in wire 40*b* is a metal plate 42, whose one side bears the mercury-containing coating 43, while the other side is coated with the getter 44. The metal plate 42 is aligned perpendicular to the longitudinal axis A—A of the discharge vessel end, with the result that the underside, coated with the getter 44, of the metal plate 42 faces the pinch seal 40*a*, and the upper side, provided with the mercury-containing coating, of the metal plate 12 [sic] faces the electrode filament 41*a*. In order to facilitate welding the metal plate 42 to the lead-in wire 41*b*, the metal plate 42 has on its edge a welding lug 42*a* bent away at right angles.

Figure 8:
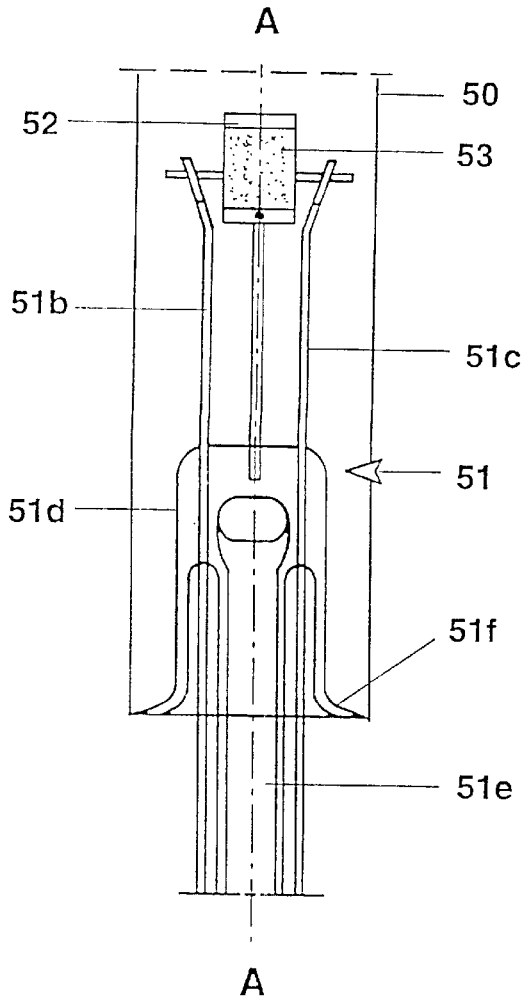
FIG. 8 shows a schematic side view of an end of a low-pressure discharge lamp in accordance with the fifth exemplary embodiment of the invention.
Figure 9:
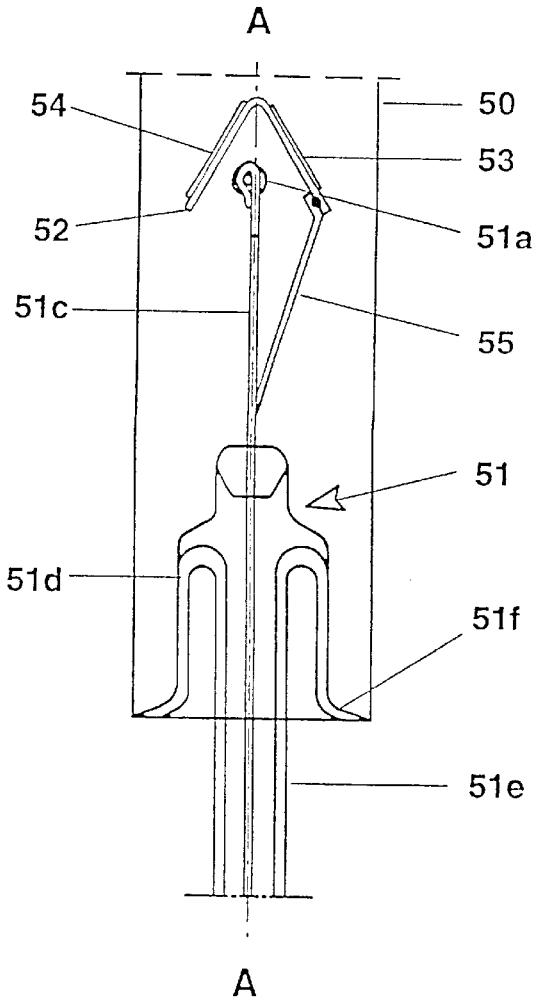
FIG. 9 shows a schematic side view of the lamp end of FIG. 8, rotated by 90°.

FIGS. 8 and 9 show an end of a low-pressure discharge lamp in accordance with the fifth exemplary embodiment of the invention, illustrated in a schematic representation. Here, as already described in the case of the third exemplary embodiment, the end of the discharge vessel 50 is sealed with the electrode frame 51 in the manner of a plate-shaped foot seal 51*d*, 51*f*. The electrode frame 51 of the fifth exemplary embodiment does not differ from the electrode frame 31 of the third exemplary embodiment. It likewise comprises an electrode filament 51*a*, two lead-in wires 51*b*, 51*c* and a glass plate foot 51*d* which is provided with an exhaust tube 51*e* and whose widened edge 51*f* is sealed with the discharge vessel end. In a manner similar to the third exemplary embodiment, the fifth exemplary embodiment has a metal plate 52 which is bent in the shape of a V and serves as support member for the getter 54 and the mercury-containing coating 53. The V-shaped metal plate 52 is likewise held with the aid of a multiply bent wire 55, which is welded to a V-leg of the metal plate 52 and sealed in the glass plate foot 51*d*. The outer surfaces and inner surfaces of the V-legs of the metal plate 52 are aligned obliquely to the longitudinal axis A—A of the discharge vessel end. The aperture angle of the V-shaped metal plate 52 is between approximately 110° and 120° so that both V-legs include with the longitudinal axis A—A in each case an angle of approximately 55° to 60°. Here, however, by contrast with the third exemplary embodiment the metal plate 52 is arranged above the electrode filament 51*a*. The mercury-containing coating 53 is applied on the outer surface, averted from the electrode filament 51*a*, of the one V-leg, while the getter coating 54 is applied on the outer surface, averted from the electrode filament 51*a*, of the other V-leg of the metal plate 52.

The invention is not limited to the exemplary embodiments described in greater detail above. For example, the V-shaped metal plates of the exemplary embodiments three and five can also be fastened to a lead-in wire by means of a fastening wire. Of course, it is also possible to fasten the support bodies in accordance with the exemplary embodiments one and four, for example with the aid of a fastening wire, in the glass plate foot or in the glass bead, respectively. Moreover, instead of the mercury-titanium alloy it is also possible to use other mercury-containing alloys or compounds for the mercury-containing coating of the support member according to the invention.

We claim:

1. Low-pressure discharge lamp, comprising a tubular discharge vessel (20; 30; 50) having one or more support members (22; 32; 52) and a filament electrode (21*a*, 31*a*, 51*a* independent of the one or more support members arranged in the interior of the discharge vessel (20; 30; 50), the support member or support members (22; 32; 52) comprises or comprise a metal plate, it being the case that the discharge vessel (20; 30; 50) has a longitudinal axis (A—A) at least in the region of its ends, the support member or the support members (22; 32; 52) has or have at least a first surface which is provided with a mercury-containing coating (23; 33; 53), the support member or the support members (22; 32; 52) has or have at least one second surface which is coated with a getter material (24; 34; 54), wherein the metal plate is bent in the shape of a U or in the shape of a V, the getter material (24; 34; 54) and the mercury-containing coating (23; 33; 53) being applied to different legs of the U-shaped or V-shaped metal plate (22; 32; 52), and the U-legs or V-legs being aligned transversely or obliquely to the longitudinal axis (A—A) of the discharge vessel (20; 30; 50).

2. Low-pressure discharge lamp according to claim 1, characterized in that the getter material (14;24;34; 44;54) and the mercury-containing coating (13;23;33; 43;53) are arranged on different sides or surfaces of the metal plate (12;22;32;42;52).

3. Low-pressure discharge lamp according to claim 1, characterized in that the low-pressure discharge lamp has two electrode frames (21;31;51) connected to the ends of the discharge vessel (20; 30;50), a support member (22;32;52) being fastened to one of the electrode frames (21;31; 51).

4. Low-pressure discharge lamp according to claim 3, characterized in that a support member (22;32; 52) is fastened to each of the electrode frames (21;31;51).

5. Low-pressure discharge lamp according to claim 4, characterized in that the support member (22) is fastened to a lead-in wire of the electrode frame (21).

6. Low-pressure discharge lamp according to claim 4, characterized in that the support member (32;52) is fastened to the electrode frame (31;51) with the aid of a fastening wire (35;55).

7. Low-pressure discharge lamp according to claim 3, characterized in that the support member (22) is fastened to a lead-in wire of the electrode frame (21).

8. Low-pressure discharge lamp according to claim 3, characterized in that the support member (32;52) is fastened to the electrode frame (31;51) with the aid of a fastening wire (35;55).

9. Low pressure discharge lamp of claim 8 wherein said electrode frame (31, 51) comprises a glass plate foot (31*d*, 51*d*), and further wherein said fastening wire (35, 55) comprises one end attached to a support member (32, 52) and an opposite end sealed in the glass plate foot (31*d*, 51*d*).

10. Low pressure discharge lamp of claim 9 wherein said filament electrode (51*a*) is disposed between said support member 52 and said glass plate foot (51*d*).

11. Low pressure discharge lamp of claim 3 wherein the support member (52) is disposed between a first filament electrode (51*a*) attached to one electrode frame (51) at one end of the lamp and a second filament electrode (51*a*) attached to another electrode frame (51) at another end of the lamp.

12. Low pressure discharge lamp of claim 11 wherein a support member (52) is fastened to each of the electrode frames (51), each support member (52) being disposed between the first and second filament electrode (51*a*).

13. Low-pressure discharge lamp according to claim 1, characterized in that the mercury content of the mercury-containing coating is less than 10 mg.

14. Low-pressure discharge lamp according to claim 1, characterized in that the outside diameter of the tubular discharge vessel (20;30;50) is less than or equal to 16 mm.

* * * * *